US005125420A

United States Patent [19]

Livingston

[11] Patent Number: 5,125,420

[45] Date of Patent: Jun. 30, 1992

[54] PROCESS FOR UTILIZING ETHYLENE AND HEAT TO ACCELERATE THE YELLOWING OF TOBACCO IN A TOBACCO CURING AND DRYING PROCESS

[76] Inventor: Larry J. Livingston, P.O. Box 5799, Virginia Beach, Va. 23455

[21] Appl. No.: 505,567

[22] Filed: Apr. 6, 1990

[51] Int. Cl.[5] ..... A24B 3/18

[52] U.S. Cl. ..... 131/302; 131/303; 131/310

[58] Field of Search ..... 131/310, 300, 302, 303, 131/304

[56] References Cited

U.S. PATENT DOCUMENTS 4,836,222 6/1989 Livingston .

OTHER PUBLICATIONS

Walker et al., "Physical and Chemical Characteristics of Flue Cured Tobacco Cured with and Without Ethylene Gas" Tob Sci. 29: 92-98, Jan. 18, 1985.

Rakitan, Yu V. et al., "Acceleration of the Process of Curing of Tobacco Leaves With the Aid of Ethylene" Jun. 16, 1975, Academy of Sci. USSR Fiz106ogiya Rastenill vol. 23, No. 5, pp. 1077-1082.

Gayed "Levels of Ethylene and $CO_2$ During Flue-Curing of Tobacco" Tob. Sci. XXII, 39-40-Dec. 1978.

Sisler et al., "Effect of Ethylene and Olefins on Tobacco Leaves" Tob. Sci. XVII 68-72 Oct. 1972.

Sisler, "Role of $CO_2$ in Reversing Ethylene Action in Tobacco Leaves" Tob. Sci. XXIV: 53-55 Nov. 1989.

Goren et al., "Ethylene Binding" Tob Sci. 28: 110-115 Sep. 1983.

Sisler et al., "Ethylene, the Gaseous Plant Hormone" Bio Science vol. 34, No. 4, pp. 234-238 Apr. 1984.

Abeles, "Ethylene in Plant Biology" published Dec. 1973, pp. 160-161.

"Guide for Bulk Curing Tobacco" published by North Carolina Agricultural Extension Service AG-101, Sep. 1983.

*Primary Examiner*—V. Millin

*Attorney, Agent, or Firm*—Rhodes, Coats & Bennett

[57] ABSTRACT

The present invention entails a method for curing and drying tobacco wherein the initial phase of the curing and drying process, that is the yellowing phase, is accelerated by the simultaneous application of ethylene and heat. In particular, the process of the present invention entails coloring the tobacco at a temperature range of 100°-120° F. and actually applying a concentration of ethylene to the tobacco while the tobacco is subjected to this coloring temperature range.

26 Claims, 4 Drawing Sheets

PROCESS FOR UTILIZING ETHYLENE AND HEAT TO ACCELERATE THE YELLOWING OF TOBACCO IN A TOBACCO CURING AND DRYING PROCESS

FIELD OF THE INVENTION

The present invention relates to the curing and drying of tobacco, and more particularly to a tobacco curing and drying process that uses ethylene and heat to effectively color or yellow tobacco during an initial phase of the curing and drying process.

BACKGROUND OF THE INVENTION

Typically, the curing and drying of tobacco involves four phases. First, the tobacco is subjected to a coloring or yellowing process. Secondly, the leaf is wilted. Thirdly, the curing and drying process involves leaf drying. Finally, the curing and drying process includes stem drying. It is known to utilize ethylene during the first or yellowing phase of the curing and drying process. For example, see my earlier U.S. Pat. No. 4,836,222.

In the past, ethylene has been produced by the farmer in what has referred to as a catalytic generator. While the ethylene produced is not pure, farmers have used the product ethylene in the very beginning stages of yellowing. Besides the catalytic generator, farmers have used pure or even near pure ethylene from cylinders in the tobacco curing and drying process. In the case of both ethylene produced from a catalytic generator or dispensed from a cylinder, the farmer has typically simply treated the tobacco within the curing and drying structure with ethylene prior to subjecting the tobacco to the effective coloring temperatures. Generally, in this process at the beginning of the curing and drying schedule, ethylene is dispensed within the barn and the ethylene mixes with a system of circulating air and the tobacco is exposed to the ethylene-air mixture as the system of air is circulated through the barn. Typically, the temperature within the barn during the application of ethylene is maintained at or near ambient conditions. Presently, it is the recommended practice to condition or treat the tobacco with ethylene while the temperature within the barn or the drying structure is maintained at ambient temperature conditions, approximately 70°-85° F. In most cases, this has meant that no heat is added during the ethylene application phase of the curing and drying schedule. However, farmers have added heat during ethylene applications where the outside ambient temperature was sufficiently cool that heat was required to maintain a temperature range of 70°-85° in the barn.

Prior practices in curing and drying tobacco with ethylene has called for a two-step approach. The tobacco is first subjected to being conditioned by an ethylene-air mixture at ambient temperature for a selected time period. Once this conditioning step has concluded, the application of ethylene is discontinued and the second step of coloring or yellowing then proceeds. This second step entails raising the temperature from ambient conditions to the effective coloring or yellowing temperature range which is typically 90°-105° F. For the past several years this has been the standard curing and crying practice within the flue cured tobacco regions of the United States where farmers have utilized ethylene.

As pointed out above, ethylene has been used to facilitate the yellowing of tobacco in the curing and drying process. As also pointed out above, it has been a standard practice for the ethylene to be applied to the tobacco at ambient temperatures, approximately 75°-90° F. The reasons for this accepted practice is not totally clear but apparently farmers, ethylene suppliers, and some individuals knowledgeable in curing and drying tobacco have concluded that ethylene is most effective at ambient temperature conditions, that is temperatures of approximately 70°-90° F. One cannot be totally sure why this has been the practice. It is speculated that the fact that vegetables and fruits have been subjected to ethylene under purely ambient temperature conditions may have been an underlying factor that gave rise to this particular practice. Tobacco curing and drying is quiet different from simply ripening vegetables and fruits in as much as one must view the curing and drying process as a total process where not only the leaf is yellowed but the total leaf including the stem is subjected to an extensive drying process.

Therefore, while applying ethylene to tobacco during the curing and drying process has in the past offered advantages to the farmer, the curing and drying process with ethylene has not significantly reduced the total curing and drying time for tobacco as compared to conventional practices without ethylene.

Tobacco farmers have longed looked for ways to shorten the time period required to completely cure and dry tobacco. The reason for this is basically one of the economics. If the tobacco farmer is able to shorten the time period for curing and drying, that translates into a need for fewer tobacco barns for a given crop size and that means less capital outlay for such barns or curing and drying structures. Beyond that, it is also possible to save fuel and electricity costs by decreasing the total curing and drying period.

Therefore, there has been a need and a desire to decrease the time period required to cure and dry tobacco. While there is some evidence that the use of ethylene in a tobacco curing and drying process has the potential to shorten the curing and drying period, results do not clearly indicate a consistent and substantial decrease in curing and drying time.

SUMMARY AND OBJECTS OF THE PRESENT INVENTION

The present invention entails a tobacco curing and drying process where ethylene is actually applied in a curing and drying process when the tobacco is exposed to coloring temperatures of 105°-120° F. By subjecting the tobacco to the application of ethylene while the tobacco is exposed to coloring or yellowing temperatures within the range of 105°-120° F. significantly decreases the time period for yellowing or coloring the tobacco and such reduces the total curing and drying time and in the process saves the farmer fuel cost and electricity cost. By shortening the total curing and drying schedule this enables the farmer to accommodate more tobacco acreage per tobacco barn, thereby effectively reducing the farmers capital cost for a given size of tobacco crop.

In particular, the tobacco curing and process of the present invention entails the application of both ethylene and heat during the yellowing process. In particular, from the beginning of the yellowing process, ethylene is dispersed within a system of circulating air and the furnace of the tobacco barn is utilized to apply heat to the system of circulating air. Typically, an appropriate ethylene concentration is maintained within the barn while the temperature is advanced through the coloring range of 105°-120° F., thereby accelerating the coloring process and again reducing the total time for curing and drying.

It is therefore an object of the present invention to provide a tobacco curing and drying process of the character referred to above wherein the tobacco is subjected to ethylene conditioning while at the same time the tobacco is exposed to effective yellowing temperatures within the range of 105°-120° F. and wherein the potential for scalding and other harmful effects on the tobacco during this period is discouraged by slowly advancing the temperature through the yellowing phase from approximately 105°-120° F. at a rate of approximately 0.5°-1° F./hr.

It is therefore an object of the present invention to provide a curing and drying process for tobacco that reduces the time required for curing and drying.

Another object of the present invention is to provide a curing and drying process for tobacco wherein the coloring or yellowing phase of the process is accomplished by applying ethylene to the tobacco while subjecting the tobacco to coloring temperatures within the range of 105°-120° F.

Still a further object of the present invention resides in the provision of the tobacco curing and drying process of the character referred to above wherein the process functions to inhibit the proliferation of organisms that give rise to what is called barn rot.

Another object of the present invention resides in the provision of a curing and drying process that is economically feasible and which contributes to the production of a high quality tobacco leaf material.

Other objects and advantages of the present invention will become apparent and obvious from a study of the following description and the accompanying drawings which are merely illustrative of such invention.

DETAILED DESCRIPTION OF THE INVENTION

The present invention entails a curing and drying process for tobacco, especially flue cured tobacco. Before proceeding with a discussion of the actual process steps involved in the present invention, it may be beneficial to briefly review conventional tobacco curing and drying structures in which the curing and drying process is carried out. In this regard, it will be appreciated that tobacco is cured in a curing and drying structure, sometimes referred to as a barn or bulk tobacco barn. Presently, a majority of all flue cured tobacco in the United States is cured and dried in what is referred to as a bulk tobacco barn. Prior to the advent of the bulk tobacco barn, farmers used what is sometimes referred to as a stick barn. This is where tobacco is effectively stitched on to a stick and the tobacco filled sticks are hung in a tobacco barn. The lower portion of the barn is heated and the heated air drifts upwardly through the barn, maintaining a selected temperature within the barn. In the case of bulk barns, the tobacco is packed relatively tight within racks or containers and through a forced air furnace system, heated air is forced up through and circulated through the tobacco. Although, the various types of structures used in curing and drying of tobacco is not per se material to the present invention, for a complete and unified understanding of tobacco curing and particularly bulk tobacco barn structures, one is referred to the disclosure found in the following United States Patents which are expressly incorporated herein by reference: U.S. Pat. Nos. 3,503,137; 4,069,593; 3,105,713; and 3,866,334.

Figure 1:
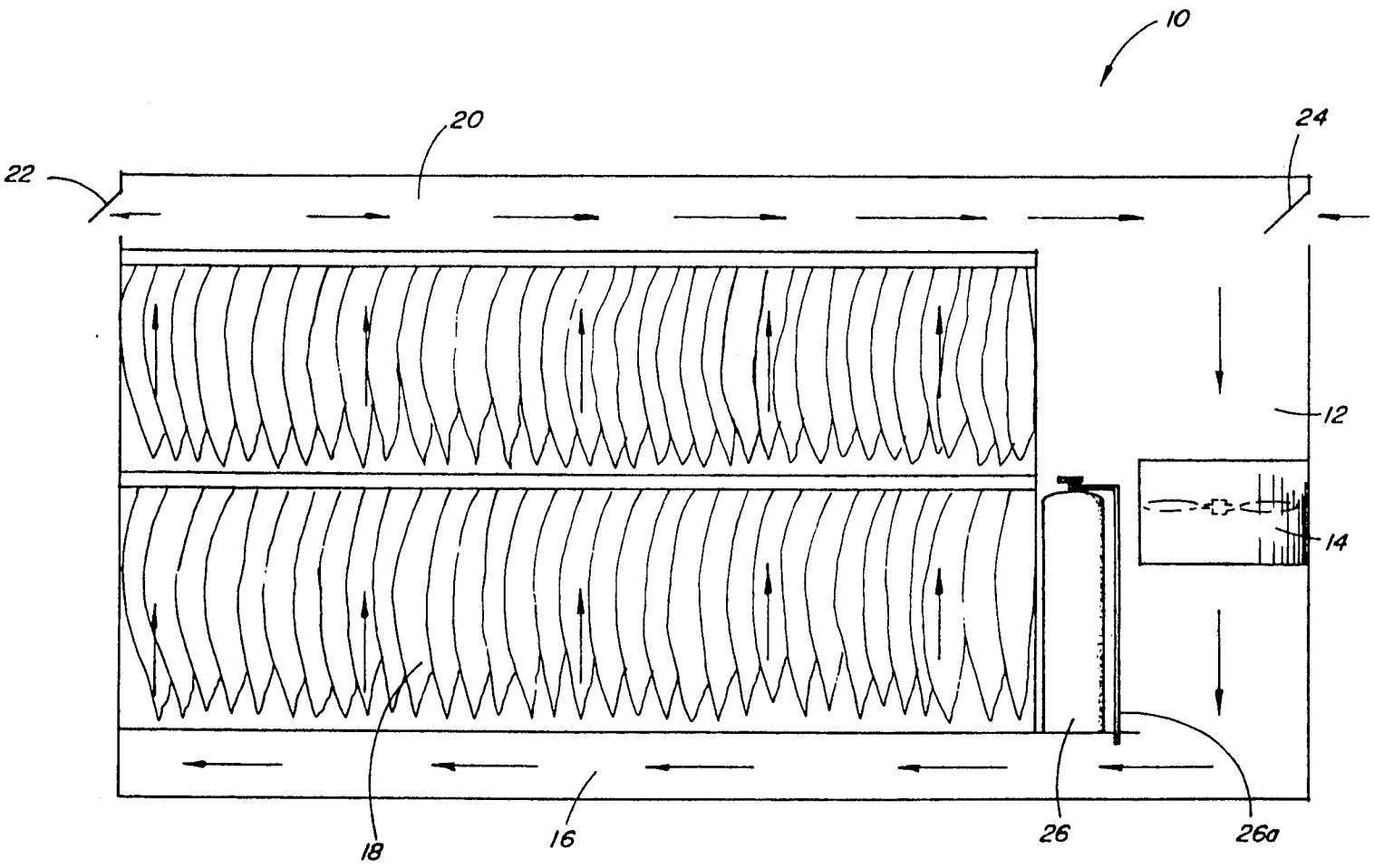
FIG. 1 is a schematic representation of a conventional bulk barn for curing tobacco.

To briefly illustrate a conventional bulk tobacco curing and drying structure, reference is made to the schematic drawing shown in FIG. 1 which shows a bulk barn which is indicated generally by the numeral 10. Viewing bulk barn 10, it is seen that the same includes a rear furnace room 12 that includes a furnace and fan indicated by numeral 14. Disposed about the lower part of the barn is a lower plenum 16 that underlies a tobacco holding area 18. Formed about the top of the barn structure 10 is an upper return area 20 that is communicatively open to an adjustable exhaust damper or vent 22. In order to induce air into the structure, there is provided an air inlet 24 adjacent the furnace room 12.

The present invention entails the application of ethylene during a selective portion of the curing and drying schedule. To accomplish this, the barn structure 10 is designed to hold and receive a gas cylinder 26 that is designed to hold ethylene. The gas cylinder 26 includes a metering control valve for dispersing ethylene from the cylinder 26 and there is provided a dispersion tube **26*a* that leads from the cylinder 26 and the control valve with the outlet end of the dispersion tube 26*a* appropriately positioned such that gas emitted therefrom enters the system of circulating air passing through the barn structure 10. From FIG. 1, it is appreciated that in a typical drying structure 10, air is pulled downwardly through the furnace 14 and forced forwardly through the lower plenum 16 where the air turns upwardly and passes through the overlying tobacco found in the tobacco holding area. Once the air reaches the upper air return area 20, the air can be circulated back to and through the furnace 14 or select portions of the air can be exhausted out exhaust vent 22** which in conventional fashion can be adjusted to accomplish a desired exchange rate of air.

In the present case, the curing and drying process is designed to disperse pure ethylene or near pure ethylene gas during the first or yellowing phase of the curing and drying schedule. Unlike prior ethylene coloring process in tobacco, the present process entails the simultaneous application of ethylene to the tobacco while at the same time subjecting the tobacco to yellowing temperatures of 105°-120° F.

In the present process, at the very beginning of the curing and drying schedule, the furnace 14 is activated with the aim of increasing the temperature within the curing and drying structure from ambient temperatures, (which would typically be 75°-90° F.) to 105° F. This is achieved as rapidly as practical, generally at a rate of approximately 2°-3° F./hr. While increasing the temperature within the structure from ambient to 105° F., ethylene is dispersed into the circulating air stream via the ethylene cylinder 26 and its dispersing tube 26*a*. During this process, the farmer maintains the ethylene concentration within a range of 25-150 ppm, and preferably in a range of 40 to 100 pprm. This concentration range can be adjusted by controlling the rate of supply from the ethylene cylinder 26 and controlling the amount or volume of air exhausted and induced into the structure via vents 22 and 24 respectively. Once the farmer has reached approximately 105° F. in the first coloring or yellowing phase, the rate of increase of the temperature is decreased. In particular, once the farmer has reached 105° F., the lower end of the yellowing temperature spectrum has been reached and as the temperature is advanced from 105° F. upwardly, the temperature in cooperation with the ethylene gas will effectuate coloring or yellowing of the tobacco.

Once the lower end of the coloring spectrum temperature has been reached, that is approximately 105° F., the temperature is continued to be advanced but at a slower rate. Preferably the temperature is advanced from approximately 105° F. to approximately 115°-120° F. at a rate of 0.5° to 1° F./hr. It is important to appreciate that while the temperature is being advanced from 105° to approximately 115°-120° F. that the ethylene is still being supplied to the air and the ethylene concentration of 25-150 ppm is still being maintained. Once the yellowing temperature has been advanced to 115°-120° F., the gradual temperature increase is stopped and the temperature within the curing and drying structure is maintained at a constant temperature at approximately 115°-120° F. to complete the yellowing phase. It is possible that by the time the temperature reaches 115°-120° F. that the tobacco will be fully yellowed. Depending on the maturity and other conditions, the yellowing period can vary and in some cases it is required that the yellowing temperatures of 115 -120° F. be maintained for a selected time period after the temperature within the curing and drying structure reaches that 115°-120° F. level. Once the leaf has been appropriately yellowed, the ethylene supply to tobacco is stopped and is no longer used in the curing and drying process.

In this disclosure repeated references are made to temperature and temperature ranges. Unless specifically noted, these references are to dry bulb temperature. However, in some cases, reference will be made to wet bulb temperature and in those cases the temperature will particularly be specified as "wet bulb".

In the basic process outlined above, when the temperature is advanced from 105° to 115 -120° F. and ethylene is being applied within the curing and drying structure, it is preferred that the wet bulb temperature during this time be maintained at 100°-115° F. and most preferably the wet bulb temperature should be maintained at approximately 105° F. during this time period.

The following is a general description of the tobacco curing and drying process of the present invention. Once the tobacco has been placed in the barn in the case of a bulk tobacco barn a system of forced air is circulated through the tobacco. First, the temperature will be raised from ambient, for example, 85° F., to approximately 105° F. If the temperature is raised at 2° F./hr. this will mean that this initial period will consume 10 hours. While the temperature is being raised from ambient to 105° F., ethylene, preferably pure ethylene from a cylinder, is being supplied and mixed within the circulating forced air system. The ethylene emission should be controlled such that the ethylene concentration within the curing and drying structure is maintained at a concentration of approximately 25-150 ppm.

Once the temperature within the curing and drying structure reaches 105° F., during this yellowing phase, the continued rate of temperature increase is approximately 0.5° F./hr.-3° F./hr. In the case of this example, the temperature is raised 1° F./hr from 105° F. to 120° F. At a temperature raise of 1° F./hr. this period of the curing and drying process would consume 15 hours.

It is appreciated that as the temperature is increased from 105°-120° F. that the ethylene is still being continuously supplied to the system of air passing through the drying structure so as to maintain a concentration level of approximately 25-150 ppm. Once the temperature has advanced to approximately 115°-120° F., the yellowing process may or may not be completed, depending on the maturity of the tobacco, type of tobacco and other conditions. In the event that the tobacco is not fully yellowed, the yellowing process is continued by maintaining a generally constant temperature of approximately 115°-120° F. while continuing to supply ethylene until properly yellowed.

During this yellowing phase, the relative humidity can vary from approximately 95% at the beginning of the yellowing phase to approximately 70-75% at the conclusion of the yellowing phase. As referred to above, in the process of the present invention, effective yellowing takes place while the dry bulb temperature is maintained within the range of 105° to 115°-120° F. while ethylene is being supplied to the air or while an appropriate ethylene concentration (25 to 150 ppm) is maintained within the curing and drying structure. During this particular period it is preferably to maintain the wet bulb temperature in the range of 100°-115° F., and preferably at approximately 105° F. Therefore, during the later stages of yellowing when the dry bulb temperature is maintained between 105° and 120° F. the wet bulb temperature is maintained between 100° and 115° F. From the above, it is seen that the total yellowing phase would consume approximately 25 hours but could be shorter or longer depending on the conditions of the tobacco being treated.

The second phase of the curing and drying process is referred to as the wilting phase. Often, wilting will begin in the late stages of the yellowing process. In fact, in some cases at the conclusion of the yellowing phase, the tobacco leaf material will be fully wilted. In other cases, the wilting process will be carried out or at least partially carried out as the curing and drying process moves from the yellowing phase to the leaf drying phase. Generally, during wilting the temperature should be maintained at approximately 115°-120° F.

In any event, after yellowing and after wilting, the next phase of the curing and drying process is referred to as leaf drying leaf drying is typically achieved at approximately 135° F. Thus, the temperature within the curing and drying structure is raised from approximately 120° F. to 135° F. at the rate of approximately 1°-3° F./hr. The typical period for leaf drying is 6-12 hours and includes the time period necessary to move from 120° F. to 135° F. Typically, the relative humidity during leaf drying at 135° F. would be approximately 60%.

After leaf drying, the final stage is stem drying. Here the temperature is advanced from 135° F. ( the leaf drying temperature) to 165° F. at a rate of 1°-3° F./hr. Once the temperature reaches approximately 165° F., the stem drying phase is continued by holding 165° F. until the stems of the tobacco material have reached an appropriate moisture level. Typically the stem drying period, including the time for temperature advance, will extend for a period of 20-36 hours. Typically the relative humidity during stem drying will be approximately 40%.

Figure 2:
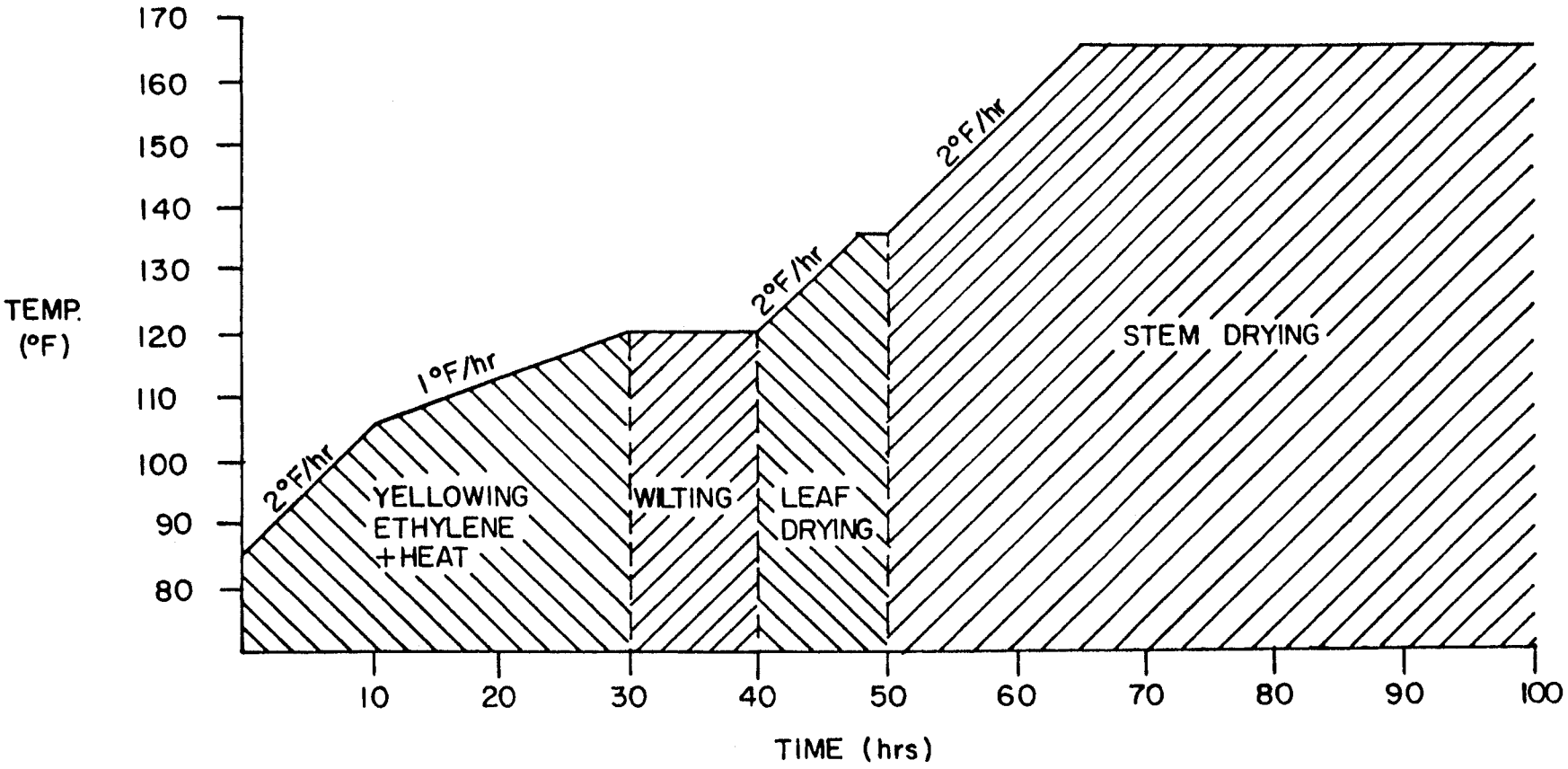
FIG. 2 is a graph illustrating the curing and drying schedule for implementing the tobacco curing process of the present invention.
Figure 3:
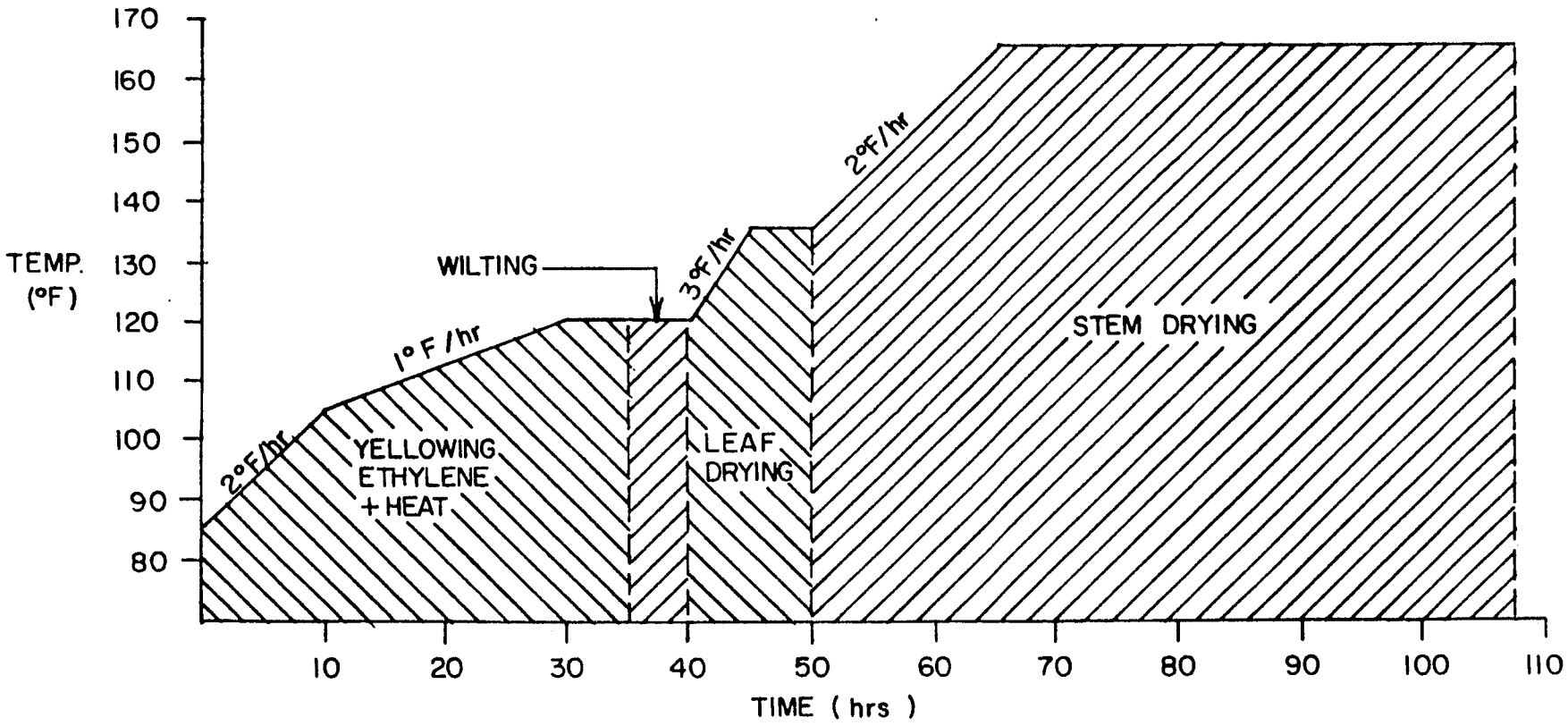
FIG. 3 is a graph illustrating a second curing and drying schedule for implementing the process of the present invention.
Figure 4:
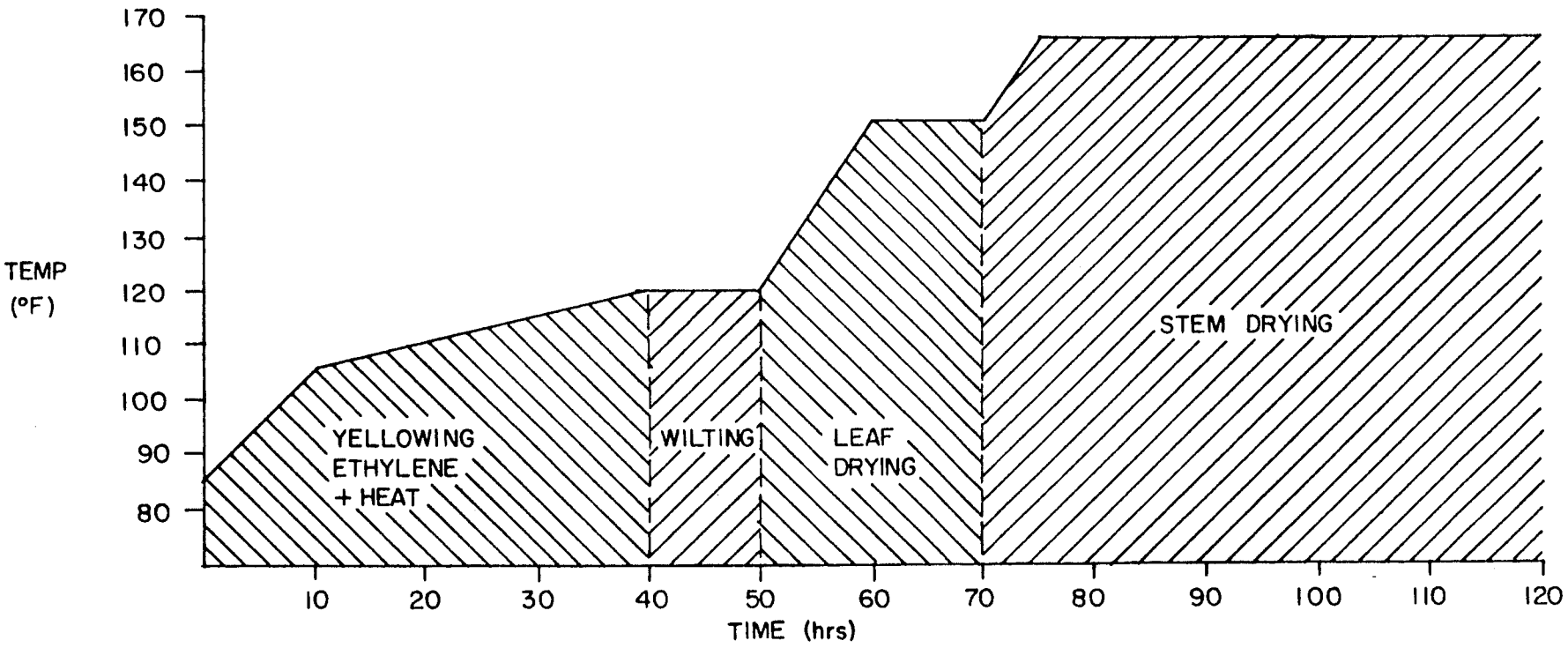
FIG. 4 is a draft illustrating a third curing and drying schedule for implementing the process of the present invention.

Now turning to FIGS. 2-4, a series of three curing and drying schedules according to the present invention are shown therein. As will be apparent from reviewing these examples, all include the yellowing or coloring phase where ethylene is applied to the air within the curing and drying structure while the tobacco is subjected to effective yellowing temperatures of approximately 105° to 120° F.

First, with respect to FIG. 2 and example 1, the curing and drying schedule starts with a yellowing period that runs 30 hours. The temperature initially within the curing and drying structure is at an ambient temperature of 85° F. From the beginning, that is starting at times 0, the furnace 14 of the curing and drying structure is actuated and the temperature within the barn is raised from 85° to 105° at a rate of approximately 2° F. per hour. Also starting at time 0 is the application of ethylene to the air within the curing and drying structure. The ethylene is dispersed within the circulating system of air and by establishing the ethylene dispensing rate from the cylinder 26 and the air exchange rates through the respective vents 22 and 24, a selected ethylene concentration of approximately 25 to 150 ppm, with the preferably range being 40 to 100 ppm can be maintained. With the ethylene concentration being so maintained, the temperature within the curing and drying structure is raised to 105° F. Once reaching 105° F., the rate of temperature increase is decreased to approximately 1° F. per hour or less. In the case of example 1, the temperature is advanced from 105° F. to 120° F. at 1° F. per hour. In example 1, once the temperature reaches 120° F. after a 30 hour yellowing period, the tobacco is sufficiently yellowed and that part of the curing and drying phase is completed. At the very beginning of the yellowing phase or period it is desirable that the relative humidity within the curing and drying structure be maintained approximately at 95% and that the wet bulb temperature be maintained at 100°-105° F. During the entire yellowing period the wet bulb temperature should be maintained in the range of 100°-115° F. For example, it is contemplated that in certain conditions, the wet bulb temperature could reach 110°-115° F. during those periods of yellowing where the dry bulb temperature is approximately 110°-120° F. Preferably during the later stage of yellowing when the dry bulb temperature is maintained between 105° F. and 115°-120° F., it is preferable that the wet bulb temperature be maintained at approximately 105° F. At the end of the yellowing period, at 30 hours, it is contemplated that the relative humidity would be approximately 70-75% while the wet bulb temperature would still be in the range of 100°-115° F.

After the yellowing phase, the temperature is maintained at 120° F. for a 10 hour period to effectuate "wilting". During this phase, the leaf is essentially wilted.

After the leaf has been wilted, the third phase of the curing and drying process entails leaf drying. In the case of example 1, starting at the 40th hour, the temperature within the structure is advanced from 120° F. to 135° F. at 2° per hour. Once reaching 135° F. the temperature is held constant there at such that the total leaf drying period extends for 10 hours, that is from the 40th to the 50th hour.

Once leaf drying has been achieved, the next step and the final step in the process is stem drying. Here in the case of example 1 starting at the 50th hour, the temperature is advanced from 135° F. to 165° F. at a rate of 2° F./hr. Once reaching 165° F. that temperature is maintained generally constant to the 98th hour of the curing and drying process. This essentially means that stem drying was effectuated in 48 hours.

Therefore, it is appreciated that the curing and drying schedule or depicted in example 1 would have a duration of 98 hours.

Now turning to Example 2, FIG. 3, a second curing and drying schedule is shown therein in accordance with the present invention. Example 2 is similar to Example 1 with the exception that the yellowing phase extends to 35 hours of time and the last 5 hours of the yellowing phase is maintained at a relatively constant 120° F. The relative humidities and the wet bulb temperatures for Example 2 would be essentially the same as those disclosed with respect to Example 1 above. In Example 2, after yellowing, there follows a 10 hour wilting period which is followed by a 10 hour leaf drying period which is followed by a 58 hour stem drying period to yield a total curing and drying period of 108 hours.

Finally, in FIG. 4, there is shown a third example of the curing and drying process of the present invention. In Example 3, the yellowing phase extends for 40 hours. Note that the temperature is first advanced from ambient which again begins at 85° F. to 105° F. at a rate of 2° F./hr. Once reaching 105° F. the yellowing phase is continued but the rate of temperature increase is decreased to 0.5° F./hr. This means that at this rate that the 120° F. temperature level is not reached until the 40th hour. As already disclosed, all during these 40 hours ethylene is being applied to the tobacco within the curing and drying structure and the ethylene concentration is maintained within the structure at a concentration level of approximately 25 to 150 ppm. The curing and drying schedule of Example 3 would be particularly suited for tobacco that was relatively green, over fertilized tobacco, or dry weather tobacco. In any event, the curing and drying schedule of Example 3 is particularly suited for tobacco that needs to be subjected to a slower and more extended yellowing period.

Continuing to refer to Example 3, (FIG. 4) after yellowing, the process utilizes a 10 hour wilting period followed by a 20 hour leaf drying period which is followed by a 50 hour stem drying period. This yields a total curing and drying time period of 120 hours or five days.

In addition, the application of ethylene may be extended into the wilting and even the drying periods in certain situations. There are cases where at the conclusion of the normal time period for yellowing that there remains a small percentage of the tobacco leaves with some green coloration. In these cases, the yellowing process can be extended and merged into the wilting and even the drying periods by continuing to disperse ethylene into the air and to maintain a desired concentration of ethylene within the curing and drying structure. In these cases, it is appreciated that an ethylene concentration of approximately 25 to 150 ppm is maintained within the curing and drying structure while the dry bulb temperature is at a drying level of approximately 135° F. The yellowing of the tobacco leaf material by conditioning with an ethylene air mixture can be continued so long as there is significant green coloration associated with the tobacco leaf material and there is still moisture within the leaf that is to be removed during the remaining curing and drying process.

There are a number of important considerations and process steps disclosed with respect to the present invention. First, the curing and drying period is effectively shortened by decreasing the time period for yellowing or coloring the tobacco. This is achieved by increasing the temperature within the structure from ambient to 105° F. while supplying ethylene and maintaining the preferred ethylene concentration range within the structure. Once reaching approximately 105° F. the temperature is advanced more slowly towards the 115°-120° F. level, while ethylene is still being supplied to the air within the drying structure and the tobacco leaf material still being exposed to appropriate ethylene concentrations. It is important that the air be continuously moved or circulated through the tobacco and that the temperature during yellowing being slowing advanced from 105° F. to 115°-120° F. That is, there is a continuous but relatively slow temperature increase during the effective yellowing temperature period. The concentration of ethylene can be adjusted and maintained within the desired range by exhausting sufficient air from the curing and drying structure through the exhaust vent or vents 22.

In the present application, the process suggests that during yellowing that the concentration range of ethylene be maintained at 25-150 ppm. It has been found that for a wide number of conventional bulk tobacco barns that this concentration range can be maintained by dispensing from the ethylene cylinder 26 one pound of pure ethylene per day while maintaining a normal or conventional coloring environment within the curing and drying stucutre. It will also be appreciated that by conventional instrumentation, for example a colormetric air sampling device, that the concentration level of ethylene in a bulk tobacco barn can be determined and that by adjusting either or both the dispensing rate from the cylinder 26 or the rate of air exhaust through the exhaust vent 22, that the ethylene concentration within the curing and drying structure can be appropriately adjusted.

The present invention has the advantage of effectively shortening the total curing and drying period by effectively shortening the yellowing period as the combined effects of the ethylene and yellowing temperature tends to accelerate the yellowing process and reduces the total yellowing phase substantially over conventional practices.

The present invention may, of course, carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of curing and drying tobacco within a tobacco drying structure comprising:

a) yellowing the tobacco by simultaneously supplying both heat and ethylene to the air within the drying structure and steadily increasing the dry bulb temperature within the drying structure from ambient to approximately 115° F. while continuously supplying ethylene to the air so as to effectively yellow the leaf by the combined action of the relatively high yellowing temperatures and ethylene; and b) after yellowing, then drying the leaf and stem portions of the tobacco.

2. The method of claim 1 including yellowing the tobacco for a period of 18 to 50 hours.

3. The method of claim 1 wherein the yellowing process includes first raising the dry bulb temperature from ambient to approximately 100°-105° F. at a relatively fast rate, and then raising the dry bulb temperature from approximately 100°-105° F. to approximately 115°-120° F. at a relatively slower rate.

4. The method of claim 1 wherein in the yellowing step the dry bulb temperature within the drying structure is first raised from ambient to approximately 100°-105° F. at a rate greater than 1° F./hr., and thereafter the dry bulb temperature is raised from approximately 100°-105° F. to approximately 115°-120 ° F. at a rate of 1° F./hr. or less.

5. The method of claim 1 wherein during the yellowing phase, ethylene concentration within the curing and drying structure is maintained at a concentration range of 25-150 ppm, and heat is continuously supplied to the drying structure to increase the dry bulb temperature within the drying structure from 100°-115° F.

6. The method of claim 1 including the step of maintaining the wet bulb temperature within the curing and drying structure between 100° and 115° F. during the yellowing process.

7. The method of claim 6 including the step of maintaining the wet bulb temperature within the curing and drying structure at approximately 105° F. during the yellowing process.

8. A method of curing and drying tobacco within a drying structure comprising:

a) first yellowing the tobacco by subjecting the tobacco to both ethylene and heat during substantially the entire yellowing phase of the curing and drying cycle;

b) during the yellowing phase, continuously supplying ethylene to the air within the drying structure while at the same time supplying heat within the curing and drying structure so as to raise the dry bulb temperature within the curing and drying structure from ambient to approximately 115° F. such that a majority of the yellowing phase is carried out while both ethylene and heat is being supplied to the tobacco within the curing and drying structure so as to maintain the dry bulb temperature during the yellowing phase at a temperature level in excess of 100° F.; and c) after yellowing, continuing to add heat within the curing and drying structure and increasing the temperature therein to effectuate leaf and stem drying.

9. The method of claim 8 wherein during the yellowing phase, the method includes initially increasing the dry bulb temperature within the drying structure from ambient to approximately 100°-105° F. at a relatively high initial rate and after reaching approximately 100°-105° F. decreasing the dry bulb temperature rate increase but continuing to increase the dry bulb temperature from approximately 100°-105° F. to approximately 115°-120° F. at a rate lower than the initial rate increase, while at the same time continuing to supply ethylene gas to the air within the curing and drying structure.

10. The method of curing and drying tobacco of claim 8 wherein ethylene is supplied continuously throughout the yellowing phase and wherein the ethylene concentration is maintained at a level of 25–150 ppm.

11. The method of claim 8 wherein the yellowing phase is carried out over a period of 18 to 50 hours.

12. The method of claim 8 including during the yellowing phase maintaining the wet bulb temperature within the drying structure between 100° and 115° F.

13. The method of claim 12 including the step of maintaining the wet bulb temperature within the curing and drying structure during the yellowing phase at a temperature of approximately 105° F.

14. The method of claim 8 wherein after yellowing the process is continued by subjecting the tobacco leaf material to a wilting period and a leaf drying period and wherein the process includes continuously applying ethylene after the yellowing phase so as to effectively yellow certain portions of the tobacco crop during a subsequent curing and drying period.

15. The method of claim 14 wherein the curing and crying process includes the step of applying ethylene during the leaf drying period of the process so as to further yellow leaf material that includes a green coloration that remains after yellowing.

16. A method of curing and drying tobacco within a drying structure, comprising the steps of:

a) yellowing the tobacco within a first phase;

b) the yellowing phase including the step of continuously supplying ethylene to the air within the drying structure over substantially the entire yellowing phase;

c) continuously heating the ethylene-air mixture within the drying structure so as to increase the temperature of the ethylene-air mixture within the drying structure from ambient to approximately 115°–120° F. dry bulb to effectuate accelerated yellowing; and d) after yellowing and reaching approximately 115°–120° F. dry bulb, discontinuing the application of ethylene but increasing the temperature within the drying structure to effectuate leaf and stem drying.

17. The method of claim 16 wherein the yellowing phase includes first raising the dry bulb temperature from ambient to approximately 100°–105° F. at a relatively high temperature rate of approximately 2°–3° F./hr. and then raising the dry bulb temperature from approximately 100°–105° F. at a relatively low rate of approximately 1°/hr. or less until the yellowing temperature reaches approximately 115°–120° F.

18. The method of claim 16 including the step of yellowing the tobacco for a time period of 20–50 hours.

19. The method of claim 16 including the step of increasing the leaf respiration rate within the curing and drying structure by subjecting the tobacco to the heated ethylene-air mixture during the yellowing phase thereby increasing the moisture removal rate from the leaf during the yellowing phase so as to decrease the total time required for leaf and stem drying.

20. The method of claim 16 including a step of actually wilting the tobacco during the final stages of yellowing such that the yellowing and wilting phases tend to overlap.

21. The method of claim 16 wherein the curing and drying process includes maintaining the wet bulb temperature within the drying structure within a range of 100°–115° F. during the later portions of the yellowing phase while the dry bulb temperature is being advanced through the range of 105° to 115°–120° F.

22. The method of claim 21 including the step of maintaining the wet bulb temperature during the later portion of the yellowing phase at a temperature of approximately 105° F.

23. A method of curing and drying tobacco comprising the steps of:

a) raising the dry bulb temperature within the curing and drying structure from ambient to approximately 100°–105° F.;

b) applying ethylene to the tobacco within the curing and drying structure after the dry bulb temperature has reached approximately 100°–105° F.;

c) yellowing the tobacco by heating the ethylene-air mixture and raising the dry bulb temperature within the curing and drying structure above 105° F.;

d) continuing to supply ethylene to the tobacco as the dry bulb temperature is raised above 105° F. and continuing to heat the ethylene-air mixture within the barn as the temperature has been raised above 105° F.;

e) continuing to raise the dry bulb temperature within the drying structure above 105° F. and supplying ethylene to the tobacco until the tobacco has been yellowed;

f) maintaining the wet bulb temperature within the curing and drying structure at approximately 100°–115° F. during the yellowing phase and while the dry bulb temperature is being raised above 105° F.; and g) after yellowing discontinuing the application of ethylene and raising the dry bulb temperature within the curing and drying structure to effectuate leaf and stem drying.

24. The method of claim 23 wherein during yellowing the dry bulb temperature is continuously raised from approximately 100°–105° F. to approximately 115°–120° F. while ethylene is continuously being supplied within the drying structure.

25. The method of claim 23 wherein in raising the dry bulb temperature from approximately 100°–105° F. to approximately 115°–120° F. the dry bulb temperature is increased at the rate of approximately 0.5° F./hr.–3° F./hr.

26. The method of claim 23 wherein during yellowing and while the dry bulb temperature is raised above 105° F., maintaining the wet bulb temperature at approximately 105° F.

* * * * *